US006261702B1

(12) United States Patent
McGuire et al.

(10) Patent No.: US 6,261,702 B1
(45) Date of Patent: Jul. 17, 2001

(54) EMBOSSED ROLLED STEEL AND EMBOSSING ROLL AND METHOD FOR MAKING THE SAME

(75) Inventors: Michael F. McGuire, Pittsburgh, PA (US); Kelly L. Senzarin-Kulik, Uniontown; Timm F. Perkins, Louisville, both of OH (US)

(73) Assignee: J&L Specialty Steel, Inc., Pittsburgh, PA (US)

( * ) Notice: Subject to any disclaimer, the term of this patent is extended or adjusted under 35 U.S.C. 154(b) by 0 days.

(21) Appl. No.: 09/316,509

(22) Filed: May 21, 1999

(51) Int. Cl.[7] ..... B12D 53/00
(52) U.S. Cl. ..... 428/600; 428/687
(58) Field of Search ..... 428/600, 687

(56) References Cited

U.S. PATENT DOCUMENTS

| | | | | |
|---|---|---|---|---|
| 2,116,107 | | 5/1938 | Erb | 29/18 |
| 3,145,468 | | 8/1964 | Johnson | 29/552 |
| 3,377,828 | | 4/1968 | Harmon | 72/2 |
| 3,613,319 | | 10/1971 | Takimura et al. | 51/289 R |
| 3,839,893 | | 10/1974 | Appel et al. | 72/197 |
| 3,956,915 | * | 5/1976 | Saunders | 72/198 |
| 4,059,000 | | 11/1977 | Bodnar | 72/197 |
| 4,111,032 | | 9/1978 | Rault | 72/366 |
| 4,347,722 | | 9/1982 | Ulam | 72/63 |
| 4,503,696 | | 3/1985 | Roeder | 72/197 |
| 4,742,706 | | 5/1988 | Sasaki et al. | 72/197 |
| 4,770,720 | * | 9/1988 | Kobayashi et al. | 148/111 |
| 4,938,806 | | 7/1990 | Honda et al. | 148/111 |
| 4,959,275 | * | 9/1990 | Iguchi et al. | 428/603 |
| 4,978,583 | * | 12/1990 | Wakui et al. | 428/600 |
| 4,996,113 | * | 2/1991 | Hector et al. | 428/600 |
| 5,080,326 | * | 1/1992 | Price et al. | 266/103 |
| 5,105,638 | | 4/1992 | Mito et al. | 72/41 |
| 5,263,773 | * | 11/1993 | Gable et al. | 312/406 |
| 5,312,496 | * | 5/1994 | Ames | 148/111 |
| 5,450,741 | | 9/1995 | Baensch et al. | 72/208 |
| 5,463,889 | | 11/1995 | Snyder et al. | 72/197 |
| 5,483,811 | | 1/1996 | Miller | 72/197 |
| 5,552,235 | | 9/1996 | Bastawros et al. | 428/687 |
| 5,665,455 | * | 9/1997 | Sato et al. | 428/167 |

FOREIGN PATENT DOCUMENTS

| | | | | |
|---|---|---|---|---|
| 0251759 | | 1/1988 | (EP) | B21B/1/22 |
| 0712954A1 | * | 5/1996 | (EP) . | |
| 50-24699 | * | 8/1975 | (JP) . | |
| 1592068 | | 9/1990 | (SU) | B21B/35/10 |

* cited by examiner

*Primary Examiner*—John J. Zimmerman
(74) *Attorney, Agent, or Firm*—Webb Ziesenheim Logsdon Orkin & Hanson, P.C.

(57) ABSTRACT

A steel sheet having an embossed pattern of straight parallel grooves along the longitudinal axis of the sheet which replicate an abrasively polished surface. Furthermore, a working roll with the embossing pattern comprised of matching channels is disclosed along with methods for imparting the embossed pattern to the steel sheet. Finally, a method for fabricating the channels within the working roll is disclosed utilizing an abrasive element against the periphery of the roll.

14 Claims, 5 Drawing Sheets

EMBOSSED ROLLED STEEL AND EMBOSSING ROLL AND METHOD FOR MAKING THE SAME

BACKGROUND OF THE INVENTION

1. Field of the Invention

The invention relates to embossed rolled steel sheet. More specifically, the invention relates to embossed rolled steel sheet with a surface pattern that replicates an abrasively polished surface along with a method and apparatus for producing the same.

2. Description of the Prior Art

A significant portion of the flat rolled stainless steel sheet used commercially has a polished finish. The finish is generally produced by abrading the surface to produce a sanded appearance. This sanded appearance may also be produced by embossing on the steel sheet a similar pattern. While embossing generally provides the visual equivalent of the abraded surface, a relatively small percentage of steel sheet is processed in this fashion to produce such a surface.

However, abrasive finishing is costly and time-consuming and may produce an inconsistent surface that is prone to defects, such as polishing chatter, pits, and abrasive belt marks.

FIG. 1 illustrates a section of steel sheet 10 having a surface 15 with a sanded appearance. The surface 15 includes a multiplicity of slits 20 oriented about a longitudinal axis 25 generally in a random fashion.

As seen in FIG. 2, the slits (not shown) on the surface 15 of the sheet 10 are produced by moving the sheet 10 in a direction 30 from a payoff reel 32 past an abrasive roller 35 which has abrasive tape 40 about the periphery of the roller 35 to a take-up reel 37. A relatively rigid roller 45 opposes the roller 35, thereby permitting the abrasive tape 40 of the roller 35 to be applied against the sheet 10 with a predetermined pressure. Furthermore, the roller 35 rotates as indicated by arrow 47 against the direction 30 of travel of the sheet 10 by a motor 50 and a connecting belt 55.

The surface 15 of the sheet 10 contacts the roller 35 only tangentially such that rotation of the roller 35 against the surface 15 produces the short slits 20 found in FIG. 1. In general, the length of these slits along the longitudinal axis 25 is between 5 to 10 millimeters and these slits are unevenly spaced since they correspond with the locations of the individual pieces of grit on the abrasive tape 40.

While this surface finish is aesthetically pleasing, in the event a portion of the surface becomes damaged, once repaired the sanded appearance must be reproduced. It is extremely difficult to reproduce this appearance because of the randomly spaced longitudinal slots 20 and it is equally difficult to provide a seamless transition between the repaired surface and the original surface. For that reason, a different type of surface finish was sought that would be more amenable to being repaired.

FIG. 3 illustrates a portion of a steel sheet 110 having a surface 115 with a plurality of grooves 120 extending parallel to a longitudinal axis 125.

As illustrated in FIG. 4, the grooves 120 in the surface 115 of the sheet 110 are produced by moving the sheet 110 in the direction of arrow 130 from a payoff reel 132 between an element 135 having an abrasive surface 140 and a rigid roller 145 opposing the element 135 to a take-up reel 147. The abrasive surface 140 extends across the entire width of the sheet 110 such that when the sheet 110 is moved in the direction 130, the plurality of grooves 120 is produced over the surface 115 of the sheet 110.

This surface finish is more amenable to being repaired; however, as previously mentioned, abrasive finishing is costly and time-consuming and may produce an inconsistent surface with defects. As an example, FIG. 5, which is an optical microscopy image of a steel sheet of stainless steel type 304 having an AISI number 3 polished finish to give the appearance of a brushed finish, illustrates typical surface tears and pits, not uncommon when abrasive polishing is used.

Steel sheet surfaces with these defects have associated disadvantages. First of all, the exposed steel sheet with surface tears and pits is more prone to corrosion than a surface without these. Furthermore, polished steel sheet is used on equipment in contact with food, chemicals and pharmaceuticals because of its resistance to corrosion and oxidation. It is important for the surface finish to be aesthetically pleasing, cleanable and resistant to corrosion. The cleanability of the sheet is significantly reduced by the introduction of such defects. Furthermore, as highlighted in the discussion of FIG. 4, the abrasive surface 140 is urged against the surface 115 of the sheet 110 and therefore a typical abrasive element 135 must be replaced approximately every 5,000 feet of surface that is abraded. Finally, the speed at which the sheet 110 travels past the abrasive element 140 is generally approximately 50 feet per minute. This produces a bottleneck since, for the most part, all of the other processes associated with finishing the sheet run at much higher speeds.

For that reason, a sheet is desired with a surface pattern that provides the same relative ease of repair to damage on the brushed surface but does not have the disadvantages associated with the damage caused by abrasion, relatively short life of the abrasive element and relatively slow speed associated with the abrasion process.

BRIEF SUMMARY OF THE INVENTION

One embodiment of the invention is an embossed steel sheet having a longitudinal axis comprising a plurality of straight grooves in the steel sheet which are continuous and parallel to one another defining an embossed pattern of straight grooves along a groove axis with each groove having associated with it one valley and two peaks. Each groove also has a wall connecting the peak of the groove to the valley of the groove with the vertical distance between the peak and valley of the groove defining the depth of the groove.

In a second embodiment of the invention, a steel sheet is embossed with a pattern using a method comprising the steps of providing a steel sheet having a sheet longitudinal axis and embossing the steel sheet by rolling the steel sheet with a working roll having a plurality of straight channels in the roll periphery along a channel axis which are continuous and parallel to one another defining an embossing pattern of straight channels along the channel axis. Each groove also has a wall connecting the peak of the channel to the valley of the channel with the vertical distance between the peak and valley of the channel defining the depth of the channel.

A third embodiment of the invention is a method of making an embossed steel sheet having surface characteristics optimized to improve repairability, corrosion resistance and cleanability of the sheet surface, the method comprising the steps of providing a steel sheet having a sheet longitudinal axis and embossing the steel sheet by rolling it using a textured working roll so that the resulting embossed steel sheet has a plurality of straight grooves which are continuous and parallel to one another defining an embossed pattern of straight grooves along a groove axis. Each groove also has a wall connecting the peak of the groove to the valley of the groove with the vertical distance between the peak and valley of the groove defining the depth of the groove.

A fourth embodiment of the invention is a roll on a temper mill used to emboss a surface pattern onto steel sheet, wherein the roll has a roll longitudinal axis and a roll radial axis and wherein the surface of the roll is comprised of a plurality of straight channels along the roll periphery which are continuous and parallel to one another defining a roll surface pattern, and wherein each channel also has a wall connecting the peak of the channel to the valley of the channel with the vertical distance between the peak and valley of the channel defining the depth of the channel.

A fifth embodiment of the invention is a method for fabricating a roll on a working mill used to emboss a surface pattern onto steel sheet comprising the steps of rotating the roll about a roll longitudinal axis, pressing an abrasive element against one end of the roll at the periphery of the roll, and traversing the abrasive element across the roll to impart a pattern to the periphery defined by a plurality of straight channels along a channel axis which are continuous and parallel to one another.

Other objects and advantages of the present invention will become apparent and obvious from the study of the following description and accompanying drawings which are merely illustrative of such invention.

DETAILED DESCRIPTION OF THE PREFERRED EMBODIMENTS

Figure 6:
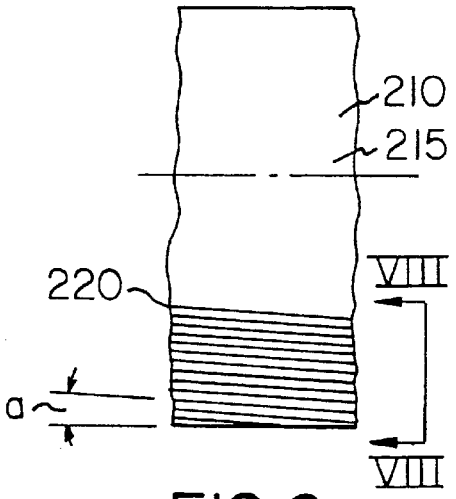
FIG. 6 shows a portion of steel sheet in accordance with the present invention having an embossed surface made up of a plurality of parallel grooves angled relative to the longitudinal axis.

FIG. 6 illustrates a top view of a section of sheet 210 having embossed upon its surface 215 a plurality of grooves 220 which are straight, continuous and parallel to one another defining an embossed pattern of straight grooves 220 along a groove axis 222. A separate longitudinal axis 225 extends along the length of the sheet 210. As illustrated in the perspective view in FIG. 7 of this same sheet, groove 220 has associated with it one valley 230 and a first peak 235 and second peak 240. It should be appreciated that each groove 220 has a common peak with an adjacent groove.

Each groove 220 also has a first wall 245 and a second wall 250 connecting the peak 235, for example, to the valley 230 of the groove 220. The vertical distance d between the peak 235 and a valley 230 of a groove 220 defines the depth of the groove 220. In a preferred embodiment, the arithmetic average surface roughness (RA) of the grooves 220 in the sheet 210 in a direction transverse to the longitudinal axis 225 is from about 5 to 50 micro inches. Furthermore, the average peak count across a transverse section of the sheet 210 is approximately between 325 to 500 peaks per inch. These parameters, which, as will be explained, are imparted to the sheet 210 utilizing an embossing process which provides a surface generally equivalent to an AISI number 3 polished finish.

Figure 5:
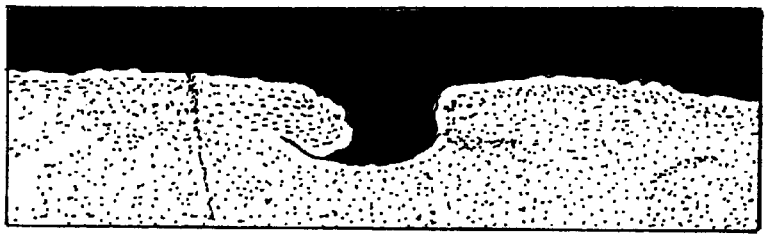
FIG. 5 is prior art and shows an optical microscopy image at 1,000× showing the surface of a sheet of stainless steel type 304 with the abraded surface sketched in FIG. 3.
Figure 8:
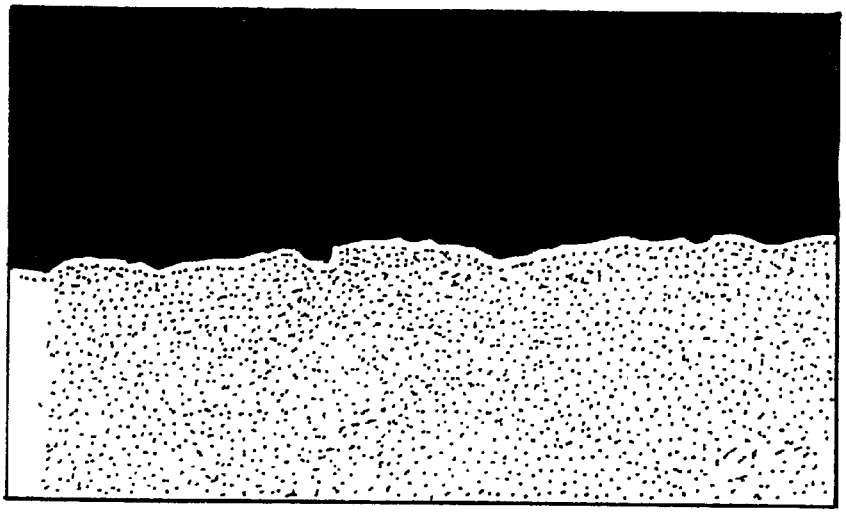
FIG. 8 illustrates an optical microscopy image at 1,000× showing the surface of the steel sheet in accordance with the subject invention.

However, unlike the relatively rough surface illustrated in FIG. 5 caused by abrasion polishing, the relatively inclusion-free finish is imparted to the surface utilizing the embossing process. FIG. 8 is an optical microscopy image at 1,000× showing the surface 215 of the sheet 210 of stainless steel type 304 subsequent to the embossing process. This process as shown provides a much smoother finish. As an example, the arithmetic average surface roughness of the surface illustrated in FIG. 5 in a direction transverse to the longitudinal axis is approximately 25–45 micro inches compared to the values of 5 to 50 micro inches associated with the embossed surface of FIG. 8.

Figure 7:
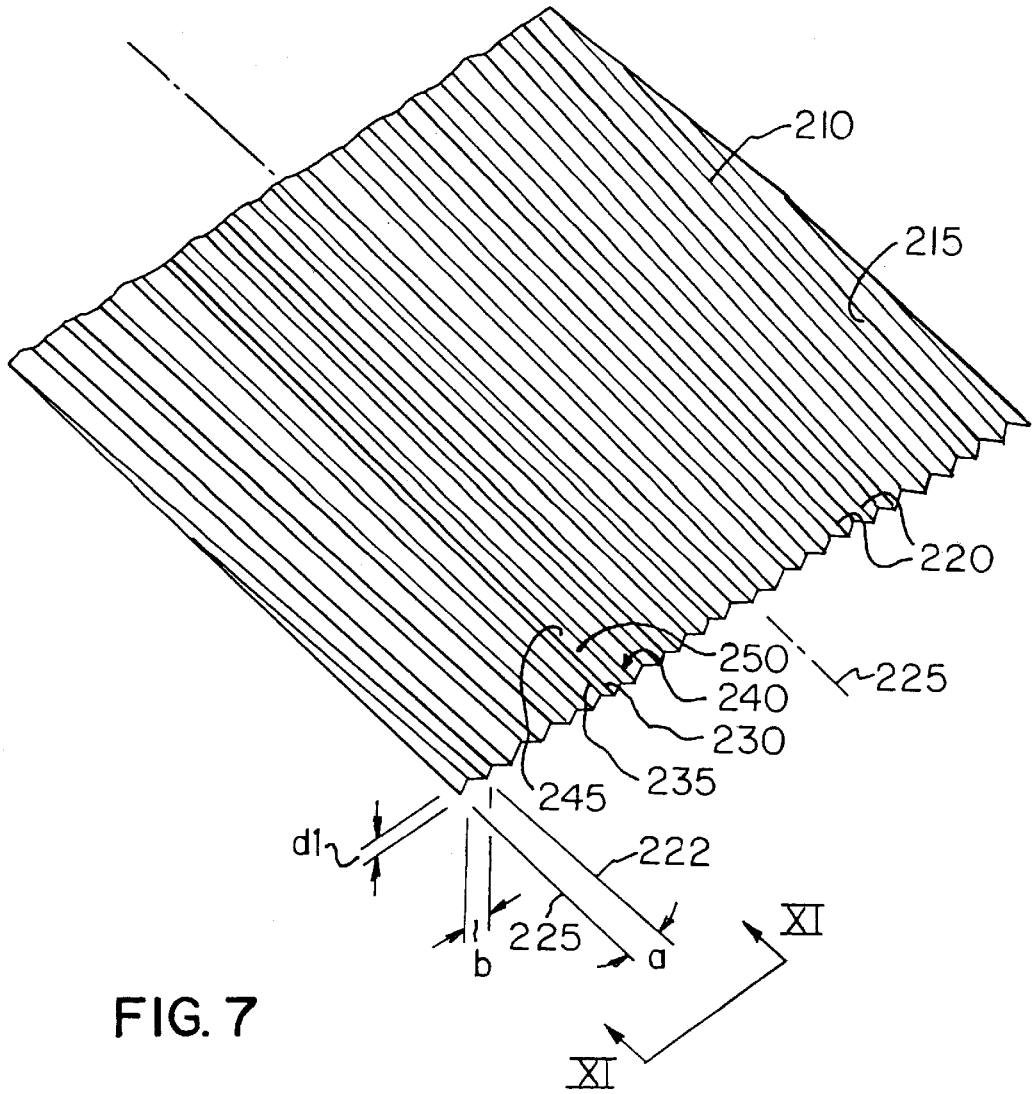
FIG. 7 illustrates a perspective view of a section of the steel sheet in accordance with the subject invention.

It should be noted that both FIG. 6 and FIG. 7 illustrate a groove angle (a) measured between the longitudinal axis 225 and the groove axis 222. Since it is desirable for the orientation of the grooves 220 relative to the longitudinal axis 225 to be as close to parallel with the longitudinal axis 225 as possible, it is desired to make the groove angle (a) as low as possible. Therefore, the groove angle (a) may have a value of between 0° and 5° and, as will be seen, is entirely a function of the embossing process.

While the average depth d of a groove 220 is approximately 196 micro inches, the maximum depth of a groove 220 is approximately 283 micro inches.

The sheet 210 may be any bright annealed strip and may include steel selected from cold rolled steel, hot rolled steel, coated sheet steel or other metals such as aluminum, copper or bronze which have a bright shiny surface. The preferred sheet is a bright annealed stainless steel sheet having a bright shiny surface requirement.

Figure 9:
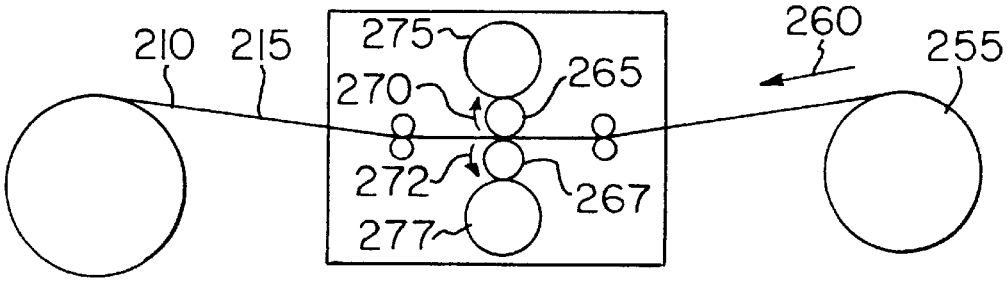
FIG. 9 illustrates a sketch of an apparatus utilized to emboss the surface finish of the subject invention onto the steel sheet.

One embodiment of the method and apparatus for embossing the pattern upon the sheet 210 is illustrated in FIG. 9. The sheet 210 is drawn from a payoff reel 255 in a direction illustrated by arrow 260 to a take-up reel 257. The strip 210 is fed between working rolls 265 and 267 which rotate in clockwise directions as illustrated by arrows 270 and 272, respectively. Each roll 265, 267 is supported by a backup roll 275, 277. As an example, the sheet 210 is passed between the working rolls 265 and 267 on a standard temper mill wherein at least one of the working rolls 265, 267 has specially designed grooves which will be discussed. The sheet 210 passes through the rolls with standard roll force, roll crown and tension and at an elongation on the order of 1% and less. While the same sheet 210 would move through an abrasive grinding operation at a speed of approximately 50 feet per minute, a speed of 1,000 feet per minute is typical when the working rolls 265, 267 are utilized to impart a pattern onto the surface 215 of the sheet 210.

Figure 10:
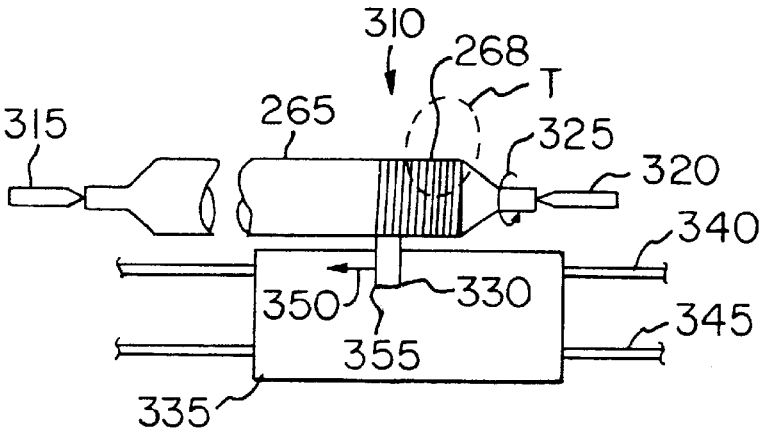
FIG. 10 illustrates a method and apparatus utilized to impart the embossing pattern onto a temper roll.

FIG. 10 illustrates a sketch of an apparatus utilized to impart embossing channels into the working roll. In one embodiment, an unfinished working roll 265 is mounted within a lathe 310 on two centers 315 and 320 and rotated in a direction indicated by arrow 325. An abrasive element 330 is supported on a block 335 which moves linearly along rails 340 and 345 in a direction indicated by arrow 350. Mounted upon the abrasive element 330 is an abrasive tape 355 comprised of, for example, grit having a size of approximately 170 microns. Such a tape is standard in the grinding industry and available from 3M and generally identified as Scotch Brite® tape.

Because the width of the tape 355 is not as wide as the length of the roller 265, to grind the working roll embossing channels 268, it is necessary to traverse the belt 355 over the surface of the working roll 265, thereby producing a helical pattern on the periphery of the working roll 265.

In actuality, there is a single helical embossing channel on the working roll, but for purposes of this discussion it will be referred to as a series of channels. This helical pattern, when embossed onto the steel sheet 210, will manifest itself on the sheet 210 (FIG. 7) as the series of parallel grooves 220 oriented relative to the longitudinal axis 225 of the sheet 210 at a groove axis angle (a). For that reason, the feed rate of the abrasive tape 355 over the face of the working roll 265 will be very low in an effort to produce the smallest channel axis angle (b) (FIG. 11) possible within a reasonable amount of time. As previously mentioned, ideally, the groove axis angle (a) should be 0°. However, utilizing the technique described with FIG. 10, it is impossible. Therefore, with the understanding some angle is required, the channel axis angle (b), and therefore the groove axis angle (a), will be so small that the perception of an observer will be that the grooves are parallel to the longitudinal axis 225.

Figure 11:
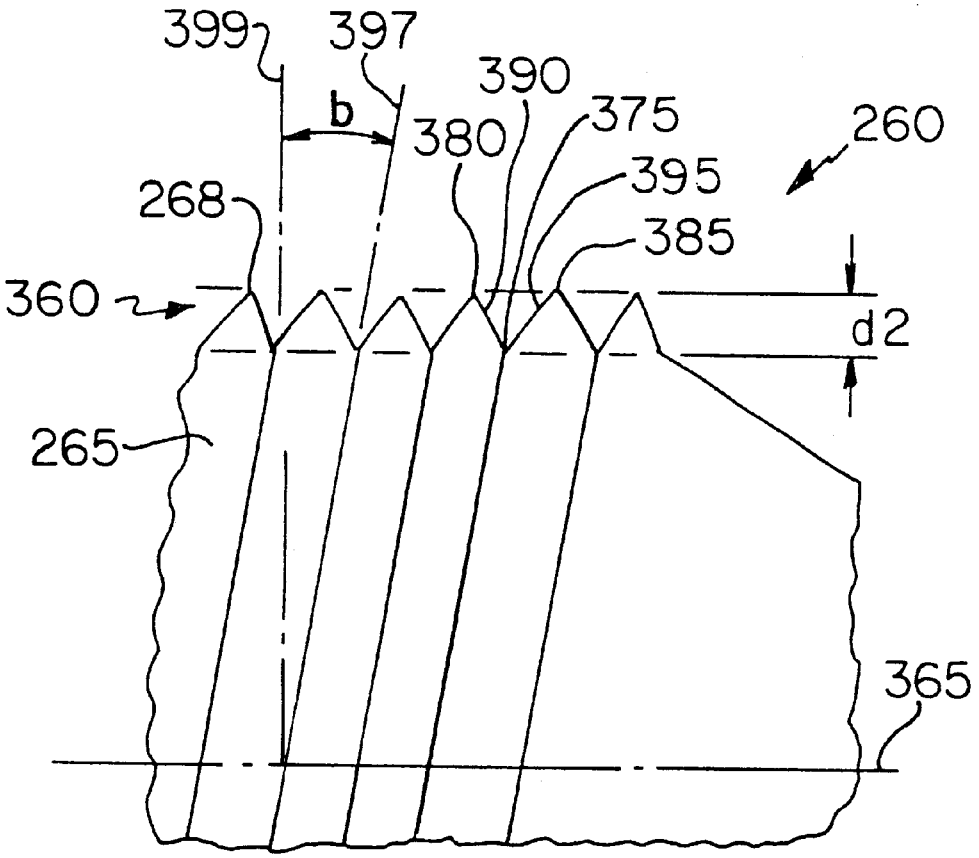
FIG. 11 is an enlarged view of the portion labeled "T" in FIG. 10.

FIG. 11 illustrates an enlarged portion of the working roll 265 portion circled and identified as item T. The pattern on the working roll 265 is imparted directly to the surface 215 (FIG. 7) of the sheet 210. The peripheral surface 360 of the working roll 265, which is about a central axis 365, has a plurality of channels 268, each with a valley 375 and a first peak 380 and second peak 385, which define within the channel 268 a first wall 390 and a second wall 395. However, unlike with the sheet 210, the depth d2 between a peak 380 and valley 375 is greater than the depth d1 in FIG. 7. Furthermore, the average surface roughness RA on the periphery of the working roll 265 is approximately between 75 micro inches and 105 micro inches. The average peak count across the width of the working roll 265 is between approximately 325 and 500 peaks per inch. It should be noted the average peak count of the working roll periphery is also different from the average peak count imparted to the sheet 210. Since the depth of each valley of the working roll 265 is different, there may be some valleys that are relatively deep and, as a result, the surface 215 of the sheet 210 will never contact them to conform to their shape. As a result, the sheet 210 will have fewer peaks than the working roll 265.

A roller channel axis 397 is aligned with each channel 268 and oriented relative to a radial axis 399 extending perpendicular to the longitudinal axis 365 of the roller 265 to form a channel axis angle (b) which is identical to the groove axis angle (a) associated with the sheet 210 illustrated in FIG. 7. For that reason, the pattern imparted to the sheet 210 is the projection of the pattern on the face of the working roller 265 as the roller 265 is rotated across the sheet 210.

What has been described so far is a sheet 210 in which grooves 220 are imparted at an angle (a) relative to the longitudinal axis 225 as illustrated in FIG. 7. What has also been described is an apparatus for imparting this pattern to the sheet 210. As mentioned, the angled pattern on the sheet 210 and the helical pattern on the roller 265 to impart this pattern are caused entirely by the mechanism used to impart channels 268 to the roller 265. The apparatus described in FIG. 10 by its operation will impart such a pattern.

It is possible, however, using the same principles of the subject invention to impart to a roller a pattern without such an angle.

Figure 12:
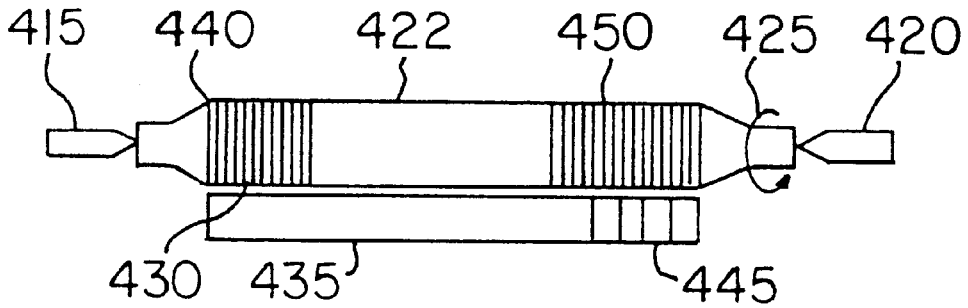
FIG. 12 illustrates another method and apparatus for imparting the embossing pattern onto a temper roll.

FIG. 12 illustrates an arrangement by which two centers 415 and 420 support a roller 422 which rotates in a direction indicated by 425 about the centers. An abrasive element 430 supported by a block 435 is urged against the periphery 440 of the roller 465 until channels 450 are imparted to the sheet 210.

While the arrangement discussed in FIG. 10 includes an abrasive element 330 having a relatively small width, it is entirely possible to place a series of such abrasive elements side by side as illustrated by elements 445 which may be placed side by side to create one unitary abrasive element as indicated by 430. Such an arrangement may be utilized not only to provide grooves which are parallel to the longitudinal axis of the sheet 210 but furthermore may do so utilizing an operation which takes less time since the entire roll 465 is being acted upon by the abrasive elements 330 at one time.

Figure 1:
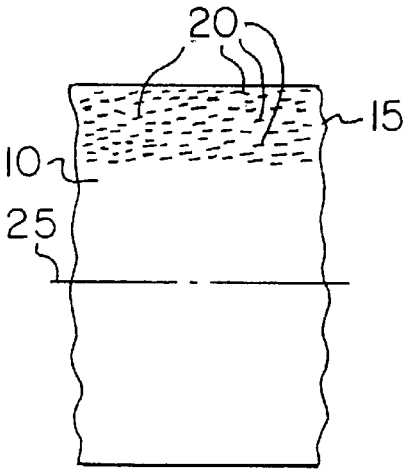
FIG. 1 PRIOR ART
FIG. 1 is prior art and represents a sketch of the surface of an abraded steel sheet with a multiplicity of longitudinally oriented short slits.
Figure 3:
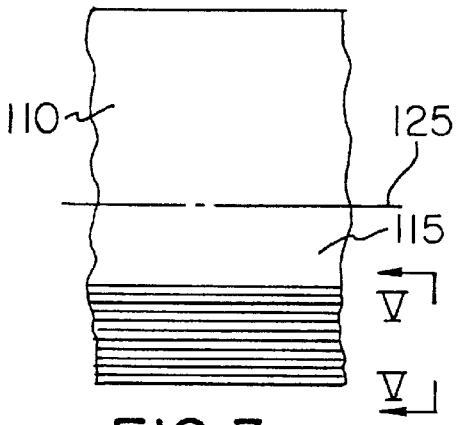
FIG. 3 PRIOR ART
FIG. 3 is prior art and shows the surface of an abraded steel sheet with a plurality of longitudinally oriented, parallel grooves.
Figure 2:
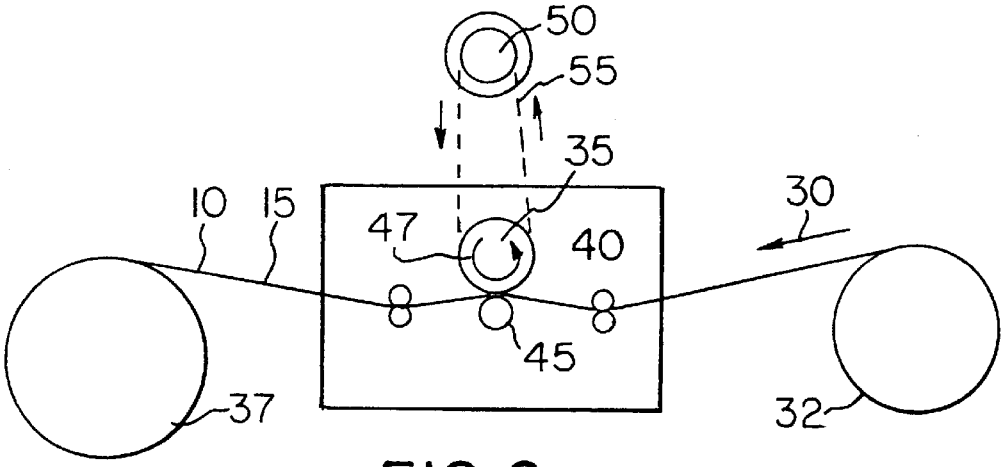
FIG. 2 PRIOR ART
FIG. 2 is prior art and illustrates a sketch of the apparatus utilized to produce the surface finish in FIG. 1.
Figure 4:
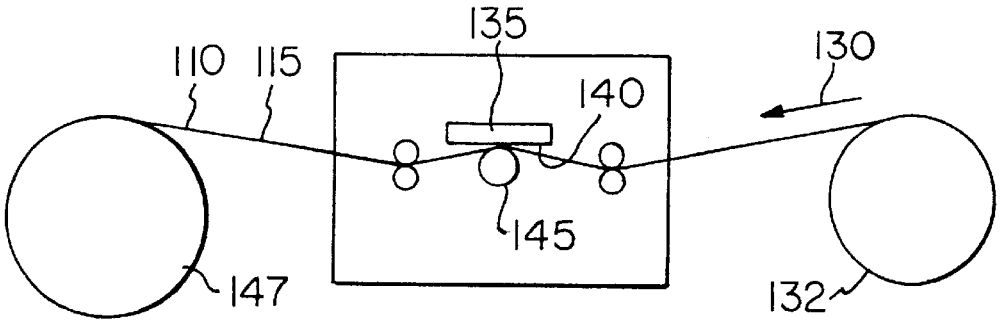
FIG. 4 PRIOR ART
FIG. 4 is prior art and illustrates a sketch of the apparatus utilized to produce the surface finish in FIG. 3.

The abrasive elements 330 and 430 illustrated in FIGS. 10 and 12, respectively, may be slowly indexed to refresh the grit contacting the rollers but not to avoid imparting any geometry to the face of the roller 265. As an example, recall in the discussion of the prior art displayed in FIGS. 1 and 2 that the rotation of the roller 35 imparted a plurality of slits 20 to the sheet 10. Since the intention of indexing the abrasive elements 430 is only to refresh the grit and not to impart any shape, then the abrasive elements 330 and 430 may be mounted to a wheel which may slowly rotate at a rotational speed of, for example, between 10 and 20 revolutions per minute.

The subject invention imparts an embossed pattern to steel sheet which improves corrosion resistance and furthermore improves cleanability of the sheet surface. As an example, Table 1 shows the results of a corrosion test utilizing sheet finished in accordance with the subject invention versus sheet abrasively polished to a standard AISI #4 polished finishy using as specimens a sheet of Type 304 stainless steel and Type 201 stainless steel. The data in this table indicates the time for a known quantity of material to be corroded from the sheet when a voltage is applied to the sheet while submerged in a 3.5% solution of sodium chloride.

TABLE 1

| Breakdown Potential in 3.5% NaCl (V vs. SCE) | | |
|---|---|---|
| | #4 Polish | Long Grain |
| 304 | 0.346 | 1.194 |
| 201 | 0.061 | 0.494 |

As illustrated, the corrosion resistance of the sheet fabricated in accordance with the subject invention is significantly greater than the corrosion resistance of a similar sheet with an abrasion polish.

Furthermore, because the sheet fabricated in accordance with the subject invention has fewer occlusions and pits, the cleanability is much greater, which is extremely important in commercial uses of the sheet where cleanliness is important.

Table 2 illustrates the results of cleanability tests using Type 304 stainless steel sheet subject to an AISI #4 polished finish, the embossing procedure of the subject invention, and a sheet finished with a standard AISI 2B finish. Standard stains were used.

TABLE 2

| | #4 Polish | Invention | 2B |
|---|---|---|---|
| Sakura SG-7 Blue | Faint | Very Faint | Dark |
| Magnum 44-Red | Faint | Very Faint | Dark |
| Marks A Lot Black | Faint | None | Dark |
| Video Jet Blue | Dark | None | Dark |

As illustrated, the sheet surface in accordance with the subject invention provided greater cleanability than either of the other two sheet treatments.

What has been described is a steel sheet having a unique embossed surface which is corrosion resistance and easily cleaned. Furthermore, the roller for imparting this embossed surface to the sheet has also been described along with associated methods for imparting this surface pattern and for fabricating the embossing roller.

The present invention may, of course, be carried out in other specific ways other than those herein set forth without departing from the spirit and the essential characteristics of the invention. The present embodiments are therefore to be considered in all respects as illustrative and not restrictive, and all changes coming within the meaning and equivalency range of the appended claims are intended to be embraced therein.

We claim:

1. An embossed steel sheet having a sheet longitudinal axis comprising:

a) a plurality of straight grooves in the steel sheet which are continuous and parallel to one another defining an embossed pattern of straight grooves along a groove axis with each groove having associated with it one valley and two peaks, b) wherein each groove also has a wall connecting the peak of the groove to the valley of the groove with the vertical distance between the peak and valley of the groove defining the depth of the groove, and c) wherein the sheet is a bright annealed stainless steel sheet having a bright shiny surface requirement with a finish of at least an AISI number 3 polished finish.

2. The steel sheet according to claim 1 wherein the arithmetic average surface roughness of the grooves in a direction transverse to the longitudinal axis is from about 5 to 50 micro inches.

3. The steel sheet according to claim 1 wherein the maximum depth of a groove is about 283 micro inches.

4. The steel sheet according to claim 1 wherein the average peak count is 220 to 380 per inch.

5. The steel sheet according to claim 1 wherein the groove axis is parallel to the longitudinal axis.

6. The steel sheet according to claim 1 wherein the groove axis forms a groove angle with the longitudinal axis of greater than zero and less than 5 degrees.

7. The steel sheet according to claim 6 wherein the groove angle is 1 degree.

8. A steel sheet embossed with a pattern using a method comprising the steps of:

a) providing a steel sheet having a sheet longitudinal axis, and b) embossing the steel sheet by rolling the steel sheet with a working roll having a plurality of straight channels in the roll periphery along a channel axis which are continuous and parallel to one another defining an embossing pattern of straight channels along the channel axis, c) wherein each channel also has a wall connecting the peak of the channel to the valley of the channel with the vertical distance between the peak and valley of the channel defining the depth of the channel, and d) wherein the sheet is a bright annealed stainless steel sheet having a bright shiny surface requirement with a finish of at least an AISI number 3 polished finish.

9. The steel sheet according to claim 8 wherein the method further includes the step of rolling the steel sheet with the working roll so that the arithmetic average surface roughness of the grooves in a direction transverse to the longitudinal axis is from about 5 to 50 micro inches.

10. The steel sheet according to claim 8 wherein the method further includes the step of rolling the steel sheet with the roll so that the maximum depth of a groove is about 283 micro inches.

11. The steel sheet according to claim 8 wherein the method further includes rolling the steel sheet to produce an average peak count between 220 to 380 per inch.

12. The steel sheet according to claim 8 wherein the method further includes rolling the steel sheet to produce a groove axis on the sheet parallel to the longitudinal axis.

13. The steel sheet according to claim 8 wherein the method further includes rolling the steel sheet to produce a groove having a groove axis and having a groove angle between the groove axis and the sheet longitudinal axis of greater than 0 and less than 5 degrees.

14. The steel sheet according to claim 13 wherein the groove angle is 1 degree.

* * * * *